United States Patent [19]

Stalder et al.

[11] Patent Number: 4,968,525

[45] Date of Patent: Nov. 6, 1990

[54] METHOD FOR PRODUCTION OF FRICTION SPINNING MEANS

[75] Inventors: Herbert Stalder, Kollbrunn; Urs Keller, Seuzach; Emil Briner, Winterthur; Werner Oeggerli, Winterthur; Arthur Würmli, Winterthur, all of Switzerland

[73] Assignee: Rieter Machine Works Ltd., Winterthur, Switzerland

[21] Appl. No.: 239,607

[22] Filed: Sep. 1, 1988

Related U.S. Application Data

[62] Division of Ser. No. 119,497, Nov. 12, 1987, Pat. No. 4,901,518.

[30] Foreign Application Priority Data

Nov. 13, 1986 [CH] Switzerland ..... 04544/86

[51] Int. Cl.[5] ..... B05D 3/06

[52] U.S. Cl. ..... 427/38; 204/15; 204/24; 204/29; 204/38.1; 427/236; 427/237; 427/299; 427/402

[58] Field of Search ..... 427/236, 237, 239, 299, 427/38, 402; 204/15, 24, 29, 38.1

[56] References Cited

U.S. PATENT DOCUMENTS 3,798,136 3/1974 Olsen et al. ..... 204/15

*Primary Examiner*—Bernard Pianalto

*Attorney, Agent, or Firm*—Werner W. Kleeman

[57] ABSTRACT

There are formed at the wall of the friction spinning element bores or holes with a predeterminate bore diameter and a coating on their side facing a fiber feed duct, the coating extending over the bore edges into the bores or holes. Each bore or hole thus formed has a diameter at the bore or hole entrance or inlet which is smaller than the bore diameter of the related bore or hole. Each bore or hole has a cross-sectional area of less than 0.283 $mm^2$, but amounting to at least 0.07 $mm^2$. In this way, the undesirable penetration of fibers or fiber parts into the bores or holes is prevented as far as possible when air flows through the bores or holes at the side of the coating, while retaining a hole form or configuration which is favorable from the standpoint of airflow and blockage of the bores or holes.

7 Claims, 2 Drawing Sheets

METHOD FOR PRODUCTION OF FRICTION SPINNING MEANS

CROSS-REFERENCE TO RELATED APPLICATIONS

This application is a divisional application of the commonly assigned, copending United States application Ser. No. 07/119,497, filed Nov. 12, 1987 and entitled "OPEN END FRICTION SPINNING DEVICE FOR PRODUCTION OF A YARN OR THE LIKE AND METHOD FOR PRODUCTION OF FRICTION SPINNING MEANS". The present application is also related to the commonly assigned, copending United States application Ser. No. 07/117,841, filed Nov. 9, 1987, now U.S. Pat. No. 4,882,015 and entitled "METHOD FOR MANUFACTURING A PERFORATED BODY, FRICTION SPINNING MEANS USING THE PERFORATED BODY AND A FRICTION SPINNING DEVICE USING THE FRICTION SPINNING MEANS" and the commonly assigned, copending United States application Ser. No. 07/119,496, filed Nov. 12, 1987, and entitled "FRICTION SPINNING DRUM" now U.S. Pat. No. 4,848,079 granted July 18, 1989, the disclosures of which are incorporated herein by reference.

BACKGROUND OF THE INVENTION

The present invention relates to a new and improved method for producing a friction spinning means or element for an open-end spinning device for producing a yarn or the like by friction spinning.

Generally speaking, the open-end friction spinning device of the present development is of the type comprising two friction spinning means or elements movable relative to each other and together or coactingly forming a convergent region or zone. At least one of these two friction spinning means or elements is provided with a coating or layer forming a friction surface and with holes or perforations for passage of an airstream or airflow therethrough, the hole cross-section or cross-sectional area being smaller than 0.283 $mm^2$. There is also provided a fiber feed or transport duct extending between a sliver opening roller or roll and the at least one perforated friction spinning means or element for the pneumatic transport of fibers to the friction surface of the at least one perforated friction spinning means or element. A yarn formation position or location is present on the friction surface in the convergent region or zone between the friction spinning means or elements. Moreover, a yarn withdrawal apparatus or device serves for withdrawing the spun yarn from the yarn formation position or location.

As already indicated previously, the present invention particularly relates to a new and improved method for producing a friction spinning means or element for the above-mentioned friction spinning device, in which the friction spinning means or element is perforated for throughflow of air and a coating or layer is applied to form the friction surface.

From the German Published Patent No. 3,114,093 which is cognate with U.S. Pat. No. 4,372,109 3,114,092, there is known in this technology a friction spinning device of the previously mentioned type which has a friction spinning drum provided with through-passing cylindrical holes and a coating on its outer surface. To avoid the existence of too large a resistance to airflow through the holes or perforations, on the one hand, and undesirable passage of fibers or fiber parts through the holes or perforations, on the other hand, the holes or perforations have a diameter of 0.6 mm, which can be increased to 0.75 mm but must be at least 0.5 mm. The holes or perforations are bored mechanically in cylindrical form; this can be effected with a normal borer. It is recognized that a smaller hole diameter would be advantageous for better protection against undesirable penetration of fibers.

It is, however, equally known that boring of very small holes or perforations, where the number of holes or perforations normally provided for the friction spinning means or element is greater than 20,000, leads to problems in manufacture which cause correspondingly high fabrication costs. In order to obtain a surface at the perforated friction spinning means or elements which possesses the desired spinning characteristics or properties and a favorable coefficient of friction with regard to the fibers, the friction spinning means or element is coated, the coating thickness lying in the range of 0.025 to 0.05 mm. The coating may penetrate into the holes or perforations but excessive narrowing or constriction of the holes or perforations is however avoided. Perforated rollers or friction spinning drums with holes or perforations and a coating are also known, for example, from German Published Patent No. 2,943,063 or the corresponding U.S. Pat. No. 4,315,398 or British Patent No. 2,023,196.

SUMMARY OF THE INVENTION

Therefore with the foregoing in mind it is a primary object of the present invention to provide a new and improved method for the production of friction spinning means or elements used in open-end friction spinning devices in a manner not aftlicted with the aforementioned drawbacks or limitations of the prior art.

Another important object of this invention is to provide a new and improved method of fabricating friction spinning means or elements of a friction spinning device enabling formation of air throughflow openings through the friction surface of the friction spinning means or element(s) thereof such that undesirable sucking or drawing in of fibers is avoided as far as possible, but at the same time the conditions for airflow through the holes or perforations of the friction spinning means or element(s) are unfavorably affected as little as possible.

Yet a further noteworthy object of the present invention is directed to a novel method of manufacturing a friction spinning means or element for use in a friction spinning device, wherein there can be produced a perforated friction spinning element whose holes or perforations are structured to be favorable from the standpoint of desired airflow while precluding or at least avoiding to a considerable extent the undesired sucking in or engagement of fibers or fibrous material at the holes or perforations.

A further significant object of the present invention is concerned with a novel method of efficiently, economically and reliably fabricating a perforated friction spinning element for use in a friction spinning device and having perforations or holes structured such that there is achieved an enhanced operation of the friction spinning device.

Still a further noteworthy object of the present invention is to provide a new and improved method for production of a friction spinning means wherein the holes or perforations in the friction surface of the friction spinning means can be manufactured economically and in a fashion which fulfills the present day requirements prevailing in the friction spinning art.

Now in order to implement these and still further objects of the present invention, which will become more readily apparent as the description proceeds, the invention contemplates that the friction spinning device of the character heretofore described is manifested by the features that the holes or perforations, viewed in the airflow direction, have at their inflow or entrance opening or end located at the region of the friction surface a cross-section or cross-sectional area providing the narrowest opening of the hole or perforation and which is less than 0.283 $mm^2$, but amounts to at least 0.07 $mm^2$, that the coating or layer extends into the holes or perforations, and the thickness of such coating or layer is at least 0.05 mm.

By means of the friction spinning device constructed according to the present invention, the undesirable drawing or sucking in of fibers, especially the initial or starting portion of the fiber, is rendered more difficult, if not, in fact, impossible. This is so because the hole size at the narrowest hole section or cross-sectional region of the holes or perforations in the friction surface is maintained sufficiently small. A hole cross-section or cross-sectional area of less than 0.283 $mm^2$ corresponds, for example, in the case of a cylindrical hole or perforation, to a hole diameter of less than 0.6 mm.

Even if the edge of the hole or perforation is rounded off by the coating or layer, in a friction spinning device constructed according to the present invention, the hole cross-section or cross-sectional area of less than 0.283 $mm^2$ ensures that slipping or entry of the fibers into the hole entrance opening or inlet opening is at least made more difficult.

Advantageously, the coating or layer extends only into a part of the depth of the associated hole or perforation. The coating or layer beneficially causes widening or enlargement of the hole cross-section or cross-sectional area in a direction extending away from the hole inlet or entrance opening as viewed in the flow direction of the air. This favors a diffusor-like expansion or relaxation of the air flowing through the holes or perforations at the friction surface so that air throughflow through the holes or perforations is facilitated.

A further advantage of this hole enlargement or widening resides in the fact that, a dirt particle or contaminant penetrating into the hole does not remain caught, because of the presence of the enlargement or widening provided for each of the holes or perforations. Advantageously, the airstream flowing through the holes or perforations of the friction surface of the friction spinning means or element is generated on the mouth or downstream side of the friction spinning means or element located remote from the friction surface by an air suction device connectable or operatively associatable therewith and in close proximity thereto. At least one of the friction spinning means or elements is beneficially in the form of a hollow friction spinning drum whose one substantially cylindrical face or surface constitutes the friction surface provided with the holes or perforations. The friction surface is preferably provided on the outer surface of the friction spinning drum. The friction surface can, however, be provided on the inner surface of the friction spinning drum, as shown in German Published Patent No. 2,919,316 which is cognate with U.S. Pat. No. 4,281,507. Furthermore, one of the two friction spinning means or elements can be a friction spinning disc, one disc surface being a friction surface having the holes or perforations. These holes or perforations are preferably cylindrical and have a hole diameter of less than 0.6 mm but amounting to at least 0.3 mm; the holes or perforations can, however, have another geometrical form in section or cross-section, for example, can be angular or multi-cornered.

For the manufacture of a friction spinning means or element for the open-end friction spinning device according to the present invention, throughflow holes or bores are first formed in the friction spinning means or element in accordance with the above-mentioned method or process. These holes have a cross-section or cross-sectional area which is larger than a predeterminate final cross-section or cross-sectional area thereof after application of the coating or layer. The edge of each hole is deburred at least on the hole exit side as viewed in the airflow direction. Thereafter, the predeterminate hole cross-section is formed by applying the coating and each such formed hole or perforation has at the entrance opening or entrance of the hole onto the friction surface of the friction spinning means a cross-sectional area of less than 0.283 $mm^2$, but amounting to at least 0.07 $mm^2$. Deburring can be carried out, for instance, by the known slurry jet process.

It is advantageous to apply the coating or layer by galvanic (electro) forming and/or by plasma or vapor deposition coating. Advantageously, a first coating or layer is applied galvanically, and thereafter a second coating or layer is applied by a conventional plasma process or by vapor deposition.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it is to be understood that to simplify the showing thereof, only enough of the open-end friction spinning device and related structure have been illustrated therein as are needed to enable one skilled in the art to readily understand the underlying principles and concepts of this invention.

Figure 1:
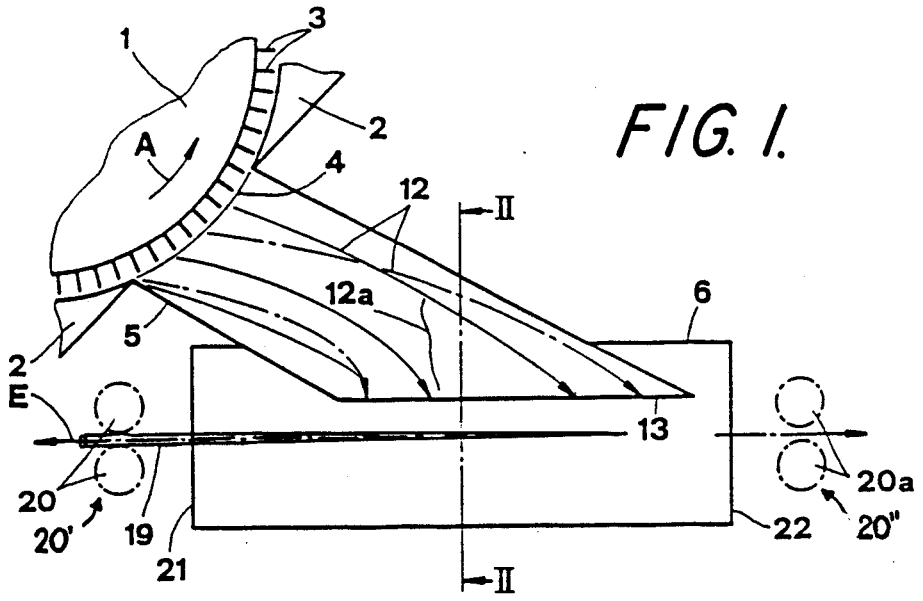
FIG. 1 illustrates schematically and partially in sectional view an open-end friction spinning device.

Turning now specifically to FIG. 1 of the drawings, a first exemplary embodiment of an open-end friction spinning device, which is of a known type and is there illustrated only in its essential details sufficient to comprehend the teachings of the present invention, will be seen to comprise an opening roller 1 which is known from the rotor spinning art. This opening roller 1 is rotatably supported in a housing 2, both of which are only partially illustrated. This opening roller 1 is appropriately driven by any suitable drive means in the direction of the arrow A. The opening roller 1 has needles 3 or the like by means of which a fiber sliver or other fibrous material is properly opened to produce individual fibers in known manner. Other opening implements, such as conventional teeth or the like (not shown) could also be used in place of the needles 3.

A fiber feed or transport duct 5 is connected to a fiber exit opening or outlet 4 of the housing 2. This fiber feed or transport duct 5 extends between the opening roller 1 and a friction spinning means or element, here depicted in the form of a friction spinning drum 6. As further shown in FIG. 2, the friction spinning drum 6 is perforated by holes or perforations 7 and has located in its interior a suction duct or nozzle arrangement or structure 8 or equivalent suction generating means, which defines by means of the boundary walls 9 and 10 a suction zone or region R at the periphery or outer surface 16 of the friction spinning drum 6. These walls 9 and 10 of the suction duct or nozzle arrangement 8 extend in close proximity to the substantially cylindrical inner wall 6' of the friction spinning drum 6, so that inflow of leakage or false air is prevented as far as possible without contact with such cylindrical inner wall 6'. The suction duct or nozzle arrangement 8 or the like is connected to an air suction device 11 and generates the transporting airstream or airflow in the fiber feed or transport duct 5.

The fibers 12 indicated in FIG. 1 by arrows and located within the fiber feed or transport duct 5, released by the needles 3 and freely floating within this fiber feed or transport duct 5, are held within the suction zone or region R by the airstream prevailing at the outer surface or region 16 of the rotating friction spinning drum 6 and bounded by the opening or outlet mouth 13 of the fiber feed or transport duct 5. In the border or marginal region of the suction zone R defined by the boundary wall 10 of the suction duct 8, the fibers 12 are twisted in at a yarn formation position or location 14 disposed on the friction spinning drum 6 in the region of the convergence or wedge zone 15 located between the outer surface 16 of the friction spinning drum 6 and an outer surface 17 of a further coacting friction spinning drum 18. The friction spinning drum 6 rotates in the direction of the arrow C and the further coacting friction spinning drum 18 which is here, for example, although not necessarily, an imperforate or unperforated drum, arranged substantially parallel to the friction spinning drum 6 and forms therewith the convergence or wedge zone 15 rotates in the direction of the arrow D.

Figure 2:
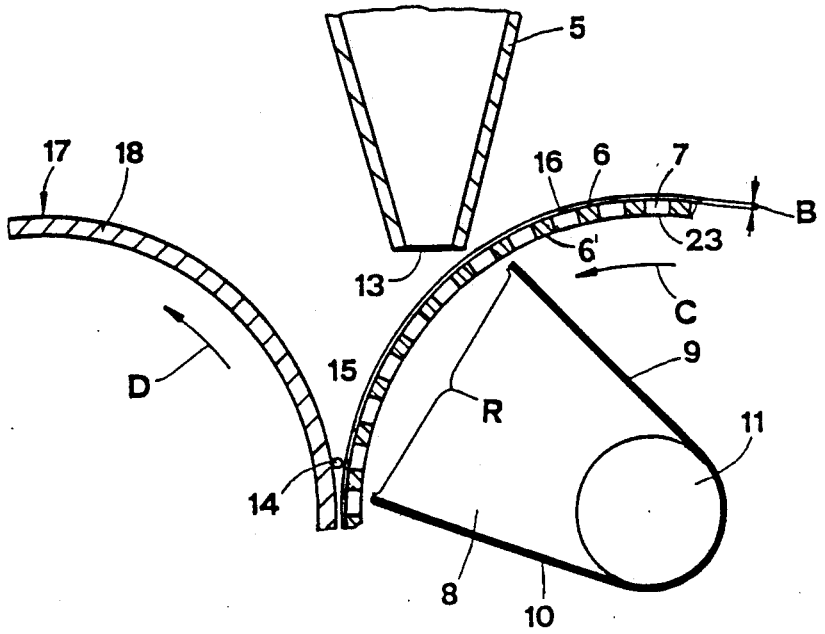
FIG. 2 illustrates in sectional view a part of the open-end friction spinning device of FIG. 1, the section being taken substantially along the line II—II thereof.

During deposition of fibers 12 on the outer surface 16, i.e. the fiber receiving surface of the friction spinning drum 6, the front fiber end or initial portion when held on this outer surface 16 acting as a friction surface, while the trailing end of the fiber is still located in the airstream or airflow of the fiber feed or transport duct 5, is turned over or somersaulted by the airstream or airflow and in a direction opposite to the direction of withdrawal of the spun yarn 19, as shown for a fiber 12*a* in FIG. 1 representative of the fibers 12. The spun yarn 19 is withdrawn, for instance, by a yarn withdrawal roller pair 20 of a yarn withdrawal device 20' in the direction of the arrow E. The yarn withdrawal device 20' is located at one end or lateral face 21 of the friction spinning drum 6. Instead of the yarn withdrawal device 20', a comparable yarn withdrawal device 20'' containing a withdrawal roller pair 20*a* could be provided at the other or opposite end or end face 22 of the friction spinning drum 6. The device shown in FIGS. 1 and 2 is, for example, described in the European Published patent application No. 175,862 (corresponding to European patent application No. 85,108,613.2, filed on July 10, 1985 and entitled "Method and Device for Forming a Yarn"), to which reference can be readily made and which is cognate with U.S. Pat. No. 4,628,697. Also of interest in this regard is the commonly assigned U.S. Pat. No. 4,660,371, granted Apr. 28, 1987, and entitled "Method and Apparatus For Producing a Yarn". Clearly, the second here, for instance, imperforate friction spinning drum 18 can be provided with holes or perforations in the same manner as the perforated friction spinning drum 6.

Figure 3:
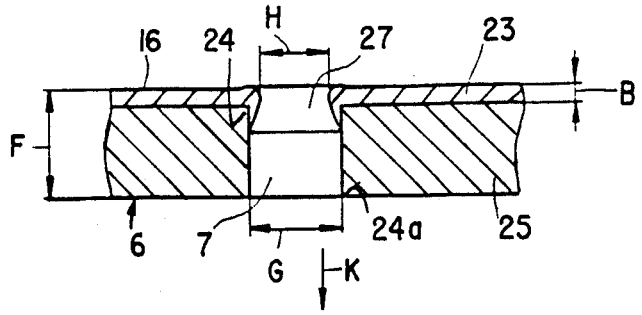
FIG. 3 illustrates schematically and in enlarged sectional view part of the friction spinning means or element of the open-end friction spinning device depicted in FIGS. 1 and 2.

As best seen by referring to FIGS. 2 and 3, the outer surface 16 is formed by a coating or layer 23 which forms the friction surface (fiber receiving surface) and extends over the hole edge 24 into part of the hole depth F of the holes or perforations 7, as clearly shown in FIG. 3. These holes or perforations 7 are bored or otherwise appropriately machined through a shell or jacket 25 forming the hollow friction spinning drum 6, with a bore hole diameter G larger, for example, by at least 0.1 mm larger, than the final hole diameter H after application of the coating or layer 23 at the hole entrance or entrance opening 27. Due to the provision of the coating or layer 23, the thickness B of which is at least 0.05 mm, the hole or bore hole diameter H is then reduced to less than 0.6 mm or less than 0.283 $mm^2$ in cross-sectional area. Formation of the coating or layer 23 within the hole or perforation 7 thus gives the possibility of manufacturing the bores or bore holes in a favorable manner, i.e. with a larger diameter G, and nevertheless of maintaining the diameter H at the hole entrance or inlet or entrance opening 27 adequately small for the spinning process. In this way, it is ensured that undesirable penetration of fibers into the holes or perforations 7 is avoided or at least made more difficult when air flows in the direction of the arrow K through the holes or perforations 7, and the leading ends of the fibers 12*a*, as viewed in the direction of arrow 12, have the tendency to follow the air through the holes or perforations 7.

The deburring of the bored holes or perforations 7, primarily of the hole edges 24 or 24*a*, is advantageously performed by, for instance, the known slurry jet method and Ely-polishing. The coating or layer 23 can be applied galvanically (electroformed) or can be a plasma or vapor deposited coating or layer. In the holes or perforations 7, the thickness B of the coating or layer 23 reduces along the hole depth F so that the hole diameter H and thus the hole cross-section or cross-sectional area increases to the hole diameter G considered in the airflow direction K. This favors both the carrying away of sucked in contaminants or impurities and also the throughflow of the air. The hole depth F is at least 0.6 mm.

Figure 4:
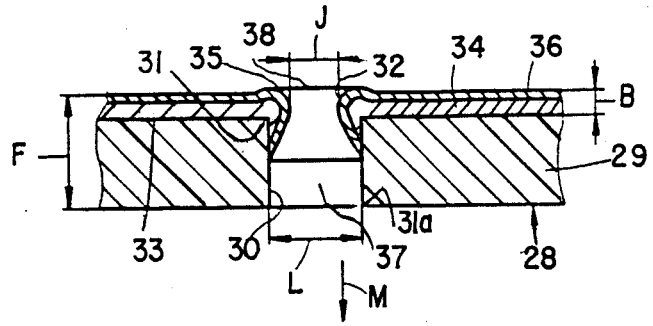
FIG. 4 illustrates schematically and in sectional view, like the showing of FIG. 3, another embodiment of part of a friction spinning means or element of an open-end friction spinning device.

In another embodiment of an open-end spinning device, as shown partially in FIG. 4, there is provided a friction spinning means or element 28 with a shell or jacket 29 and such has holes or perforations 30 bored or otherwise appropriately machined therein. These bored holes 30 are preferably deburred at their edges 31 or 31*a* by, for instance, the slurry jet technique. The hole edge 31 lies at the entrance or inlet or entrance opening 32 to the bored hole 30 on that side or surface 33 of the wall of the shell or jacket 29 at which opens a fiber feed or transport duct, which may be, for example, like the fiber feed or transport duct 5 depicted in FIGS. 1 and 2. A galvanically applied coating or layer 34 extends over the hole edge 31 into the bored hole 30 and for known reasons forms at the edge of the entrance or inlet or entrance opening 32, spaced from the edge 31, a deposit 35 which is raised or elevated in relation to the coating or layer thickness B. A second coating or layer 36 is here provided on the galvanic coating or layer 34 and forms a friction surface. The second coating or layer 36 can be a plasma or vapor deposited layer.

The raised deposit 35 is enlarged by the applied second coating or layer 36 so that, upon reduction of the diameter L of the bored holes 30, a hole or perforation 37 is formed with an entrance or inlet or entrance opening 38 at the second coating or layer 36, and thus at the friction surface, having a hole diameter J which has a cross-sectional area smaller than 0.283 $mm^2$ and a diameter smaller than the hole diameter L, but amounts to at least 0.07 $mm^2$. The coating or layer thickness B collectively relates to the first coating or layer 34 and the second coating or layer 36 and is at least 0.05 mm. Both coatings or layers 34 and 36 penetrate into the related hole 37, the degree of penetration being determined substantially by the employed galvanic technique. As stated, the coating or layer thickness B should be at least 0.05 mm.

In the same manner as in the above-described embodiments, penetration of fibers into the hole or perforation 37 can be prevented or at least minimized by the hole cross-section or cross-sectional area when air flows through the holes 37 in the direction of the arrow M. The friction spinning means or element depicted in accordance with FIG. 4 can be used in the friction spinning device portrayed in FIGS. 1 and 2 in place of the friction spinning drums shown therein.

Figure 5:
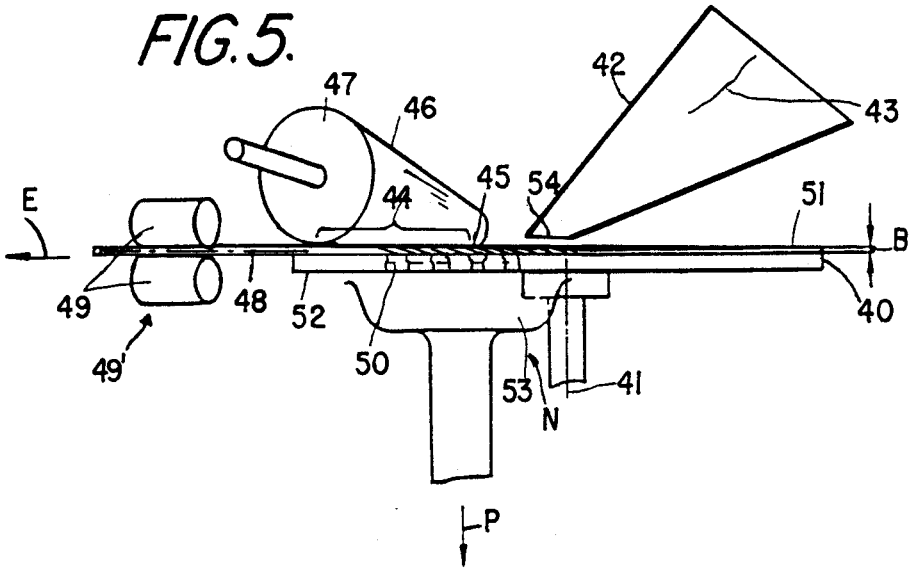
FIG. 5 illustrates schematically and partially in sectional view still another embodiment of an open-end friction spinning device equipped with the friction spinning means or element designed according to the present invention.

In the modified embodiment of friction spinning device illustrated in a partially broken away view in FIG. 5, and which type of friction spinning device is also known from the European Patent No. 175,862, a friction spinning disc 40 is rotatably supported by means of a shaft 41 and is appropriately drivable in the direction of the arrow N. Fibers 43 delivered through a fiber feed or transport duct 42 are taken up by the friction spinning disc 40 and transported to a yarn formation position 44 located in the convergence or wedge zone 45 between the outer shell or jacket 46 provided on a substantially conical roller 47 and the friction spinning disc 40.

Spun yarn 48 is withdrawn from the yarn formation position 44 by a withdrawal roller pair 49 of a yarn withdrawal device 49'. The friction spinning disc 40 has throughgoing holes or perforations 50 and is provided with a coating or layer 51 acting as a friction surface (fiber receiving surface). On the underside 52 of the friction spinning disc 40, as shown in FIG. 5, there is arranged a suction duct 53 which is effective at the region of the outlet opening or mouth 54 of the fiber feed or transport duct 42 up to and including the yarn formation position or location 44. The suction duct 53 is connected to a conventional and therefore here not illustrated suction apparatus so that air flows therethrough in the direction of the arrow P and thus also through the holes or perforations 50. In the same manner as shown in FIGS. 3 and 4, the coating or layer 51 extends into the holes or perforations 50 so that these holes or perforations 50 have a cross-section or cross-sectional area similar to H in FIG. 3 or J in FIG. 4 of less than 0.283 $mm^2$ and amounting to at least 0.07 $mm^2$. The thickness B of the coating or layer 51 is at least 0.05 mm.

Accordingly, reference is made to the description of the embodiments previously described in conjunction with FIGS. 3 and 4 for the effect of the coating or layer 51 extending into the holes or perforations 50.

Furthermore, the invention is not limited either to cylindrical hollow drums, as shown in FIGS. 1 and 2, or to friction spinning discs as described with reference to FIG. 5. It is equally possible to apply the described coatings or layers to substantially conical hollow drums, hyperboloids, as disclosed, for instance, in German Published Patent No. 2,660,060 or to perforated belts. Also, the friction surface, and hence the coating or layer, can be provided on the internal cylindrical surface of a hollow drum of the type as disclosed, for instance, in the German Published Patent No. 2,919,316.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A method for the production of a friction comprising the steps of:

forming throughflow holes at a friction spinning means for throughflow of air in a predeterminate airflow direction such that said throughflow holes of the friction spinning means possess a first predeterminate cross-sectional area;

each of said throughflow holes having a hole entrance;

deburring edges of the throughflow holes at least at the region of each hole entrance of said throughflow holes as viewed in said predeterminate airflow direction through said throughflow holes;

applying a coating to the friction spinning means at a side thereof where there are located said hole entrances in order to form a friction surface;

during the step of applying said coating to the friction spinning means at the side where there are located said hole entrances, narrowing each one of said throughflow holes in the region of its hole entrance due to the application of said coating and thereby forming in the region of said hole entrance a second predeterminate cross-sectional area for the throughflow of air and which second predeterminate cross-sectional area is smaller than said first predeterminate cross-sectional area of the remaining portion of said throughflow hole; and said second predeterminate cross-sectional area at the hole entrance of each throughflow hole being less than 0.196 $mm^2$, but at least 0.07 $mm^2$.

2. The method as defined in claim 1, wherein:

the coating is galvanically applied.

3. The method as defined in claim 1, wherein:

the coating is applied by a plasma process.

4. The method as defined in claim 1, wherein:

the coating is applied by a vapor deposition process.

5. The method as defined in claim 1, wherein:

a first layer is applied galvanically and thereafter a second layer is applied according to the plasma process to form the coating.

6. The method as defined in claim 1, wherein:

a first layer is applied galvanically and thereafter a second layer is applied according to a vapor deposition process to form the coating.

7. A method for the production of a friction spinning means for a friction spinning device, comprising the steps of:

forming throughflow holes at a friction spinning means for throughflow of air in a predeterminate airflow direction such that said throughflow holes of the friction spinning means possess a first predeterminate cross-sectional area;

each of said throughflow holes having a hole entrance;

applying a coating to the friction spinning means at a side thereof where there are located said hole entrances in order to form a friction surface;

during said step of applying said coating to the friction spinning means at the side where there are located said hole entrances, narrowing each one of said throughflow holes in the region of its hole entrance due to the application of said coating and thereby forming in the region of said hole entrance a second predeterminate cross-sectional area for the throughflow of air and which second predeterminate cross-sectional area is smaller than said first predeterminate cross-sectional area of the remaining portion of the throughflow hole; and said second predeterminate cross-sectional area t the hole entrance of each throughflow hole being less than 0.196 $mm^2$, but at least 0.07 $mm^2$.

* * * * *